US007083494B2

(12) United States Patent
Sandroussi et al.

(10) Patent No.: US 7,083,494 B2
(45) Date of Patent: Aug. 1, 2006

(54) ARTICLE OF CLOTHING WITH BUILT IN SUPPORT SYSTEM

(75) Inventors: Jewly Sandroussi, London (GB); Suzy Ratcliffe, London (GB)

(73) Assignee: Sansu Limited, Oth (GB)

( * ) Notice: Subject to any disclaimer, the term of this patent is extended or adjusted under 35 U.S.C. 154(b) by 43 days.

(21) Appl. No.: 10/662,058

(22) Filed: Sep. 12, 2003

(65) Prior Publication Data

US 2004/0137821 A1 Jul. 15, 2004

Related U.S. Application Data

(60) Provisional application No. 60/410,321, filed on Sep. 12, 2002.

(51) Int. Cl.
*A41C 3/00* (2006.01)

(52) U.S. Cl. ..... 450/31; 450/34; 2/105; 2/106; 2/67

(58) Field of Classification Search ..... 450/30, 450/31, 33, 34, 66, 70, 74–76, 92, 93; 2/69, 2/67, 105, 106, 113, 115, 73, 78.1–78.4, 243.1, 2/80, 83, 85, 77; 66/190, 171, 175, 176, 66/177

See application file for complete search history.

(56) References Cited

U.S. PATENT DOCUMENTS

| | | | | | |
|---|---|---|---|---|---|
| 4,440,174 | A | * | 4/1984 | Cordova | 450/31 |
| 4,916,755 | A | * | 4/1990 | Feigenbaum et al. | 2/67 |
| 5,033,986 | A | * | 7/1991 | Feigenbaum et al. | 450/30 |
| 5,431,030 | A | * | 7/1995 | Ishizaki et al. | 66/176 |
| 5,996,120 | A | * | 12/1999 | Balit | 2/67 |

* cited by examiner

*Primary Examiner*—Gloria M. Hale
(74) *Attorney, Agent, or Firm*—Mintz,Levin,Cohn,Ferris, Glovsky and Popeo, P.C.; A. Jason Mirabito

(57) ABSTRACT

An integrated garment including an outer layer for covering a woman's breasts, the outer laying including a top end, a bottom end and side seams and an inner layer having a perimeter and a substantial support structure extending from a front of the garment to a back of the garment in at least a bust region of the garment. The inner layer includes at least two different stitch patterns each having a respective yarn and is substantially attached along at least a portion of the perimeter to the outer garment.

15 Claims, 13 Drawing Sheets

ARTICLE OF CLOTHING WITH BUILT IN SUPPORT SYSTEM

RELATED APPLICATIONS

This application claims the benefit of priority under 35 U.S.C. §119(e) to copending U.S. Provisional Application No. 60/410,321, filed on Sep. 12, 2002, the entire contents of which are incorporated herein by reference.

FIELD OF THE INVENTION

This invention relates to women's clothing apparel, particularly garments which cover a women's breasts/bust. Specifically, the invention provides for attaching a seam free inner liner to the inside of an outer covering garment or shell to provide substantial support to the bust/torso area.

BACKGROUND OF THE INVENTION

Garments are often made having two components: the outer covering or the shell which is used for styling and design, and the inside liner which is used to provide some support and coverage for a woman's breasts and torso, rather than a bra. The term "bra" is used in reference to common breast support systems which generally have bra straps that extend from the front of the bra over a woman's shoulders, to the back of the bra. The front of the bra includes portions of the bra that directly surround or support the breasts (e.g., cups). The back of the bra generally refers to that region of the bra that passes across a woman's back. Garments having two layers can have a component that replaces the wearing of a bra.

A known structure in women's tops is to provide a garment having narrow straps over the shoulder with a built in second layer, usually in a cut and sew design secured under the breasts with a wide elastic band, often called a 'shelfbra'. Similar arrangements are disclosed in, for example, U.S. Pat. Nos. 4,398,538 and 4,798,557. Single straps are used to provide over-the-shoulder support to both the cup portions of the bra and the garment. However, in general, this design can be disadvantageous, as it does not provide the support necessary, particularly for full figured women. In an alternate version, molded cups for the breasts are added to the shelfbra, sometimes using different fabrics to hold the cups in place.

Garments are also generally available having built in bras. Such arrangements are disclosed in, for example, U.S. Pat. Nos. 5,478,278 and 5,678,246. While these arrangements may provide adequate breast support, the bra and garment are generally fixed together over portions of the body of the bra (i.e., cups, sides and back region) and the strap region. The garment is generally restrictive in that it cannot move freely relative to the body of the bra.

Frames or under wires are often used in presently available products to give some shape and support. The disadvantages of under wire are numerous: it hurts the breasts, adds unnecessary weight, and unfortunately, during prolonged use, under wires have a tendency to puncture the fabric in which they are enclosed. These additional structural elements also increase manufacturing costs. Furthermore, other regions of the torso are only minimally sculpted, compressed or modified in some manner to provide an enhanced appearance.

U.S. Pat. No. 6,336,840 provides for an article of clothing with built-in bra where the straps of the bra are fastened to the shoulder supports of a top garment substantially along the length of the shoulder supports from the front to the back of the garment. This article utilizes the traditional design of a bra (i.e., over the shoulder straps, back strap and two cups) fastened to the straps of an outer layer garment. The bra support is particularly suited for garments that are sleeveless or thin strapped, and can require constant adjusting for coverage of the straps of an underlying bra by the garment shoulder strap.

Various other inner liners that provide support are also known. In some garments, such as sports tops, the complete inner structure is connected to side seams of the outside shell. Again, this arrangement can be disadvantageous because the outer garment cannot move freely relative to the body of the inner structure.

Some garment tops have a seamless inner liner connected to a seamless outer layer. The outer layer is often necessarily tubular and tight fitting, as opposed to an outer layer having cut-and-sew designs which provide more options for the appearance and design of the garment top. In addition, the existing designs typically provide a double layer for coverage, and lack sufficient bust support. Frequently in garments, the inner liner presses against the chest and tends to compress and flatten the breast curvature, a result that often is not desirable.

In other garments, notably swimwear, the structure of the liner places control fabric in the back to provide the support. Such liners make the swimwear extremely bulky and uncomfortable.

U.S. Pat. No. 2,279,222 attempts to provide a snug form-fitting suit with front panels for supporting the breasts. The front inner liner covers the breast and is sewn within the outer garment perimeter. Such design supports the breast, but restricts the natural appearance of upper body movement.

More particularly, U.S. Pat. No. 5,996,120, attempts to provide a swimsuit design comprising an inner liner which engirdles the figure and flattens out abdominal bulge, but which does not flatten the breast curvature. It comprises an inner liner garment of elastic construction and material which serves primarily to ensure figure control. The liner is generally made from elastic material such as Spandex and engirdles the torso. The stretch of the Spandex is designed to be greater in the lateral direction than in a vertical direction, allowing ease of movement, for example, when bending over. The liner is tighter and smaller than the outer garment, and is sewn to the outer garment along their common perimeters.

U.S. Pat. No. 5,605,060 discloses a seamless body suit that is prepared from a tubular knit blank. This body suit comprises modified length stitches in order to provide support for, and yet accommodate, the breast and stomach area while provide some degree of compressive support to the mid-torso. However, this structure is not designed to provide controlling support to sculpturally shape desired regions of the torso to any substantial degree. Furthermore, there is no disclosure of different stitch types that could be beneficially used in order to sculpt a torso, nor is there any disclosure of different yarns that could be used in order to optimize the shape control function of the body suit. This body suit is made of one singular component and is not connected to any outer layer garment.

SUMMARY OF THE INVENTION

The garments of the present invention integate outer and inner components to provide bust and torso shaping and support without flattening the curvature of the breast/bust and without the need for wearing a bra. The invention thus provides highly useful and advantageous garments covering a woman's bust that have a cut-and-sew outer layer that enable freedom of design and movement, combined with a seamless inner layer providing substantial support to the bust, connected at the perimeters of the garment excluding the side seams.

Further advantages of the invention provide a support layer in a number of garments, including but not limited to, tank tops, sleeved tops, halter tops, dresses, blouses, tube tops and sweaters. In a preferred embodiment, the support layer is provided in sleeved tops having varying necklines and made of varying fabrics. The support layer provides desired shaping and curvature, while providing substantial support. The support structure accomplishes a range of support and control functions through the use of at least two different stitch patterns and yarn functions. The layered garment can provide breast support and comfort for regular use or for use during physical activity.

Embodiments of the invention include an integrated garment with an outer layer for covering a woman's breasts, the outer laying including a top end, a bottom end and side seams, and an inner layer having a perimeter and a substantial support structure extending from a front of the garment to a back of the garment in at least a bust region of the garment. The inner layer includes at least two different stitch patterns each having a respective yarn and the inner layer is substantially attached to the outer garment along at least a portion of the perimeter of the outer garment.

Implementations of the invention may include one or more of the following features. The stitch patterns can include at least two of the following stitch patterns, e.g.: a maximum support stitch under the bust, at the sides of the bust, or between the breasts or mid section, or a combination thereof; a medium support stitch in the back portion of the inner layer; and a soft selection area stitch over the bust area. The support structure can include at least two different yarns for imparting a support and control function to the support structure. The yarns can include cotton and microfiber, each in combination with an elasticized material. The elasticized material can be, e.g.,"LYCRA™ spandex" or Elastane™. The yarns can be selected from spandex, bare spandex, nylon, nylon single cover, nylon flat shiny, viscose, polyester, acrylic, wool, cashmere, mohair or rayon. The inner layer can be substantially continuous around the circumference of the top end of the outer layer. The inner layer can be substantially attached across substantially the entirety of a perimeter of the top end of the outer layer. Further, the inner layer can be smaller than the outer garment and can include a shape substantially similar to a shape of the top half of the outer layer. The inner layer can be substantially attached to an inside of the outer layer.

Further implementations of the invention can include one or more of the following features.The top with sleeves can be a sweater, a blouse, a long-sleeve t-shirt, or a short-sleeve t-shirt. Alternatively, the outer layer of the garment can be a sleeveless top. The sleeveless top can be a tube or bandeau top, halter top, or camisole top with thin narrow shoulder straps. The inner layer can be substantially attached to a perimeter of the top end of the outer layer. The outer layer can be a tank top. The inner layer can be substantially attached to a perimeter of the top end of the outer layer, substantially around the armholes and substantially across the shoulders. The outer layer can include a top with sleeves having a defined neckline. The inner layer can be substantially attached to the outer layer substantially around an entirety of the armholes and to the shoulder seams. The outer layer can also include a dress having a top half with or without sleeves. The inner layer can include a substantially similar shape as at least the top half of the dress, and the inner layer can be substantially attached to the outer layer at least at one common perimeter of the top end of the dress, around the neckline, around the shoulder seams, or the armholes.

Various embodiments of the invention provide one or more of the following advantages. The present invention, in one embodiment, provides for one integrated garment including both a cut-and-sew outer layer and a seamless inner layer, connected at the perimeters of the garment excluding the side seams. This integrated garment of outer and inner wear provides substantial support without flattening the breasts.

Articles of clothing according to the invention are particularly advantageous for use with garments covering the breast area. The garment of an article of clothing according to the current invention can be, but is not limited to, a tank top, a sleeved top (i.e., having armholes and covering a number of different neckline styles and sleeve lengths), a halter top, one shoulder top, a dress, a blouse, a tube top, and a sweater.

Connecting an inner seam free layer into the outer garments described herein gives an overall neater appearance. In addition the clothing articles provide breast support and comfort for regular use and for use during physical exercise.

The inner layer component of the invention provides a comfortable yet substantial support structure while also providing a desired shaping and curvature of breasts and mid torso without unnecessarily deforming these parts of the body. With the structure of the present invention there is no need for frames, clasps, bras, bra straps or wire supports, yet a similar degree of support and sculptural control is achieved as with these prior art structures.

This invention also embraces the inner seamless support structure as defined above, wherein the support structure is a liner for sleeveless tops of all designs, tops with sleeves of all lengths and shapes, crop tops, dresses, shirts and sweaters. Integrating the inner seamless support layer with a cut-and-sew outer layer garment provides the articles of clothing with an overall neater appearance. In addition, the articles provide breast support and comfort for regular use or for use during physical activity.

In several embodiments of the present invention, the use of at least two different stitch patterns and yarn selection provide for a range of support and control functions within an integrated garment, while still allowing comfort and flexibility of the garment to the user.

The present invention is also directed to an inner seamless support structure as defined above further characterized in comprising at least two different yarns types that aid in imparting said support and control function to said seamless support structure. In a preferred embodiment the support regions of the inner layer are formed from a combination of fabrics the main ones being (but not limited to) cotton or microfiber in combination with an elastic material such as "LYCRA™ spandex" or Elastane™. The at least two yarns may also be selected from the group consisting of Spandex, bare Spandex, nylon, nylon single cover and nylon flat shiny. Furthermore, the garment top of this invention is cost effective to manufacture and durable in nature, and provides cost savings to the consumer over purchase of the inner layer and outer layer separately.

The invention will be more fully understood after a review of the following figures, detailed description and claims.

BRIEF DESCRIPTION OF THE DRAWINGS

These and other features of the invention will become more apparent from the following description in which reference is made to the appended drawings briefly described below.

DETAILED DESCRIPTION OF THE INVENTION

The features and other details of the invention will now be more particularly described with reference to the accompanying drawings and the claims. It will be understood that particular embodiments described herein are shown by way of illustration and not as limitations of the invention. The principal features of this invention can be employed in various embodiments without departing from the scope of the invention.

Embodiments of the invention are directed to women's garments that cover the breast area. Particularly, this invention relates to a seamless inner support structure which is secured to the outer garment at the perimeters of the garment excluding the side seams, that provides a substantial degree of support while retaining the curvature of the breast. By "inner support structure" it is meant a garment that substantially controls the shape of the wearer in a desired for manner in order to, for example, enhance appearance. The support structure provides sculpturing control for the breast. Embodiments of the invention use the support structure as an inner layer to any of a number of garments. Embodiments of the invention achieve a similar degree of support and sculptural control while eliminating a need for frames, clasps, bras, bra straps, or wire supports. Embodiments of the invention can be used for garments other than garments covering the bust area, where support may be desirable.

Figure 1A:
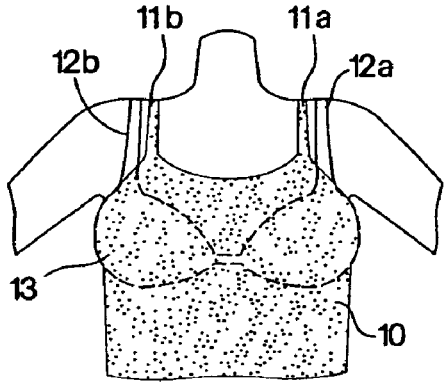
Fig. 1A PRIOR ART
FIGS. 1A, 1B, and 1C illustrate an embodiment of a prior art garment and bra arrangement.
Figure 1B:
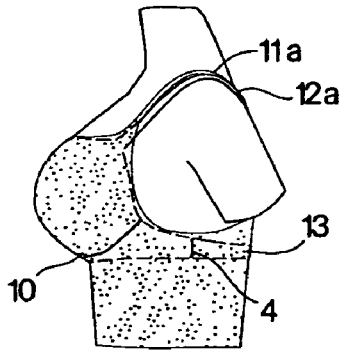
Fig. 1B PRIOR ART
Figure 1C:
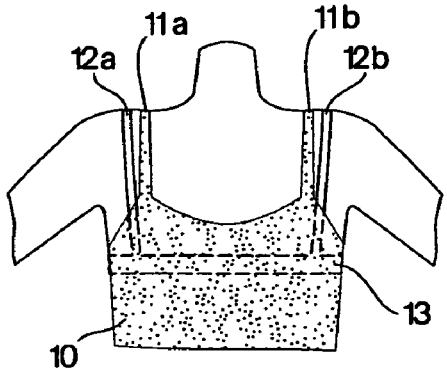
Fig. 1C PRIOR ART

Known garments having built-in support systems tend to lack necessary or desirable support or appearance. Referring to FIGS. 1A–1C, one example of a known arrangement of a bra and garment is shown. In the illustrated embodiment, a camisole top 10 having garment supports or straps 11*a* and 11*b* is shown over a bra 13 having straps 12*a* and 12*b*. The garment supports 11*a* and 11*b* are narrow and may be relatively displaced so as not to cover the bra straps 12*a* and 12*b* of the bra beneath the tank top 10. Due to the position of the bra straps 12*a* and 12*b*, the camisole 10 does not portray the desired appearance, as the straps 12*a* and 12*b* are visible, rather than concealed by the camisole.

Figure 2A:
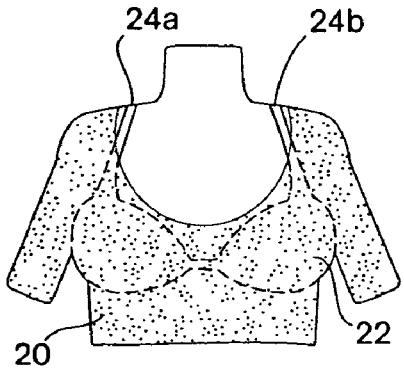
Fig. 2A PRIOR ART
FIGS. 2A, 2B, and 2C illustrate an alternative embodiment of a prior art garment and bra arrangement.
Figure 2B:
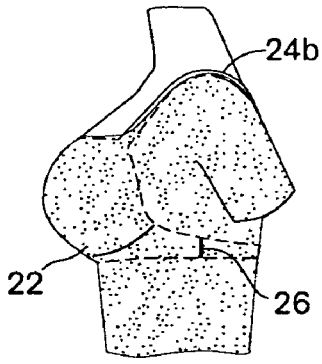
Fig. 2B PRIOR ART
Figure 2C:
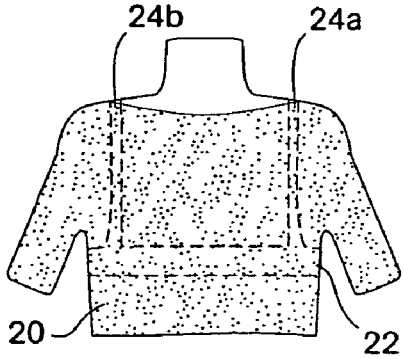
Fig. 2C PRIOR ART

Referring to FIGS. 2A–2C, an illustration of another example of a prior arrangement of a bra and fitted garment having sleeves is depicted. In the illustrated embodiment, a long sleeved top 20 is shown disposed over a bra 22 having straps 24*a* and 24*b* and side seams 26.

The top 20 is made of fabric (such as cotton, microfiber, elastane, knitwear, or any such combination) which contours to the woman's shape. In the front view, this garment requires a separate undergarment to support the breasts (such as a bra, bra liner or the like) that has no seams or lace, otherwise the seams and fabric will be visible through the outer garment. If a seamless undergarment is worn (e.g., what is commonly called a "t-shirt" bra), the indentation areas of the shoulder and back straps into the woman's skin can be seen through the outer garment giving a "lumpy" appearance. In addition, unless the undergarment is in the same color as the outer garment, it can commonly be seen through the outer garment.

Figure 3A:
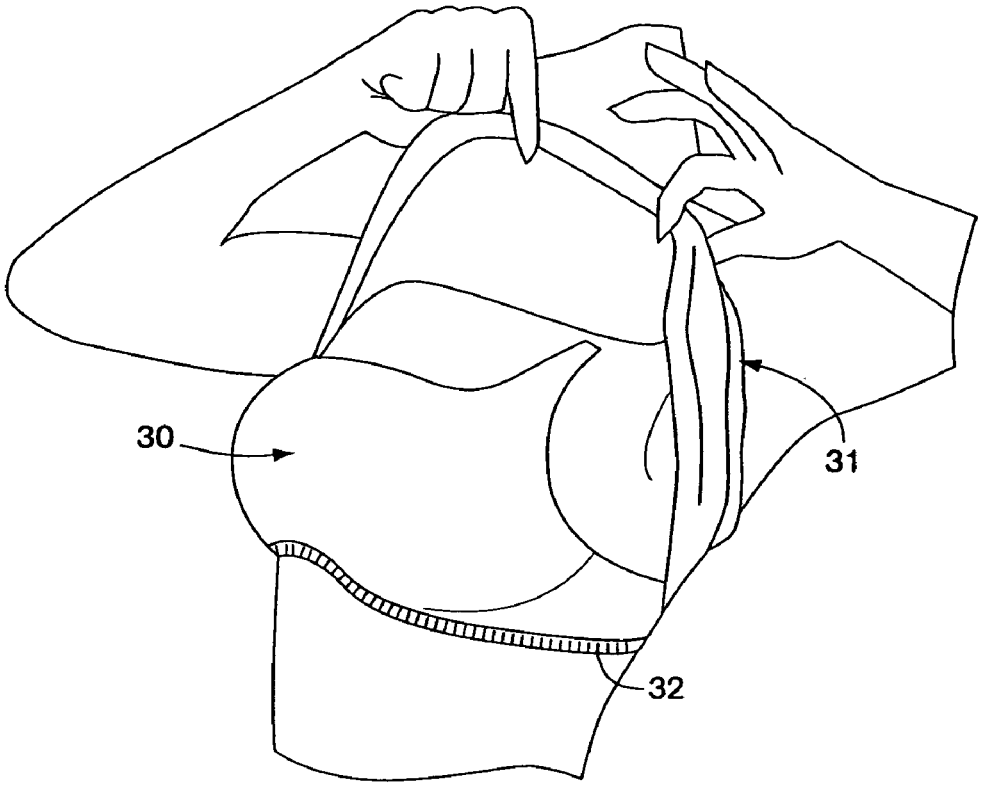
Fig. 3A PRIOR ART
FIGS. 3A and 3B illustrates an alternative embodiment of a prior art garment and bra arrangement.
Figure 3B:
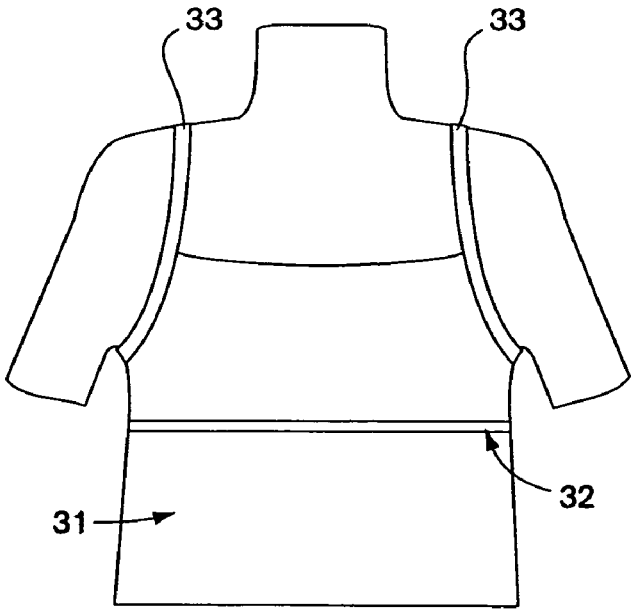
Fig. 3B PRIOR ART

FIGS. 3A and 3B illustrate an additional known bra for wearing under a shirt. The bra 30 includes thin straps 33 and an under-bust band 32, which may be elastic. The bra 30 further includes an inner liner. The inner liner presses against the chest and tends to compress and flatten the breast curvature, resulting in a "barrel effect" that often is not desirable. This design is also disadvantageous as it does not provide the support necessary, particularly for full figured women.

The present invention tends to alleviate some or all of the disadvantages of the prior art, described above. In addition, the present invention may include further advantages not present in the art. As recited above, the invention includes a garment that integrates outer and inner components to provide bust and torso shaping and support without flattening the curvature of the breast/bust and without the need for wearing a bra.

Referring to FIGS. 4–11, a number of variations on an inner support structure and, the garments to which the inner supports are attached, are shown. It is also considered within the scope of the present invention that the support structure may comprise any shape that will be required to suit the shape and design of any outer garment that covers the breasts.

Figure 4A:
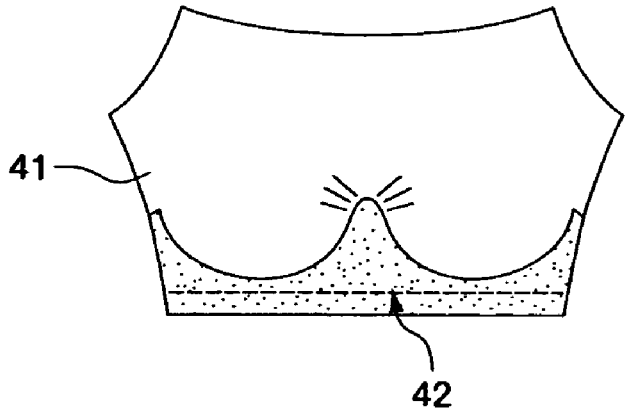
FIGS. 4A and 4B illustrate an outer garment and inner support structure arrangement according to one embodiment of the invention.
Figure 4B:
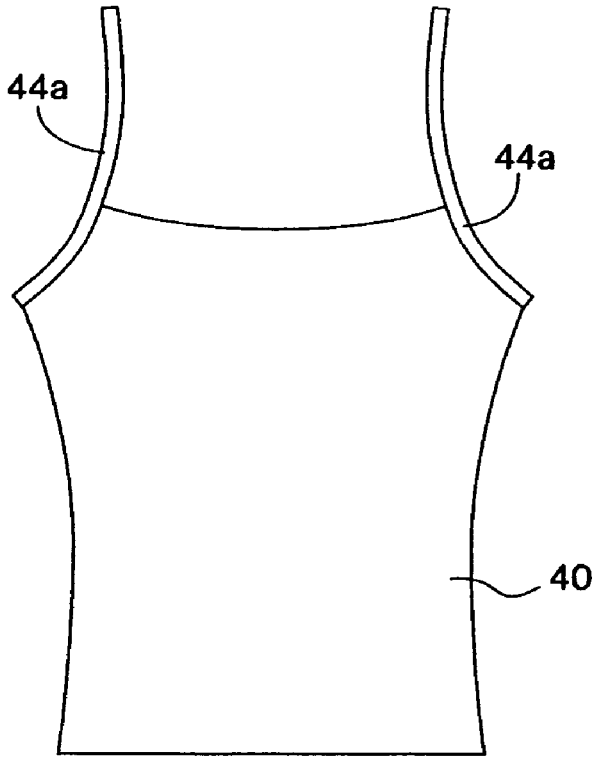

With reference to FIGS. 4A and 4B, one embodiment of a clothing article according to the present invention comprises an outer garment connected to an inner support structure arrangement. The garment is illustrated as worn by a female figure. The clothing article includes an outer garment 40 and an inner support structure 41. The outer garment 40 covers at least the bust area and has straps 44*a*. The breasts are uplifted by the inner support structure 41 and the inner structure 41 is not visible through the outer garment. The outer garment 40 follows the contour of the female form as controlled and enhanced by the inner liner. The inner support structure 41 is seam-free and of a molded shape using various stitch patterns and yarns, which will be further discussed below. As such, the breasts retain their curvature without being flattened by the inner liner.

The inner support structure 41 and outer garment 40 are connected at common perimeters. For example, the support structure and outer garment can be connected along the neckline of the outer garment, around the arm holes, or at any point at which the support structure 41 and outer garment 40 coincide, generally excluding the side seams as the sole point of connection, although the side seams can be an overlapping point of connection of the support structure 41 and the outer garment 40. In region 42 of the inner support structure 41, the fabric tightens the weave of the garment to create support around the breast area. The inner support structure 41 differs from the outer garment 40 in that the inner support structure is composed of yarns, stitch types and tensions that create a fitted garment to support curves of the body. In contrast, the outer garment 40 is a cut-and-sew garment, meaning the size of the outer garment is determined by the size of the pieces of fabric cut and sewn together. The inner support structure 41 is tubular, or seamfree in construction. Since the fabric is seamfree/tubular, there are no visible seams.

As referred to above, various stitch patterns and yarns are used to accomplish the necessary support in the inner support system 41. The area of the body which has been targeted for support is the bust area—underneath the bust, around the sides of the bust, between the breasts and around the back. The control and support of the inner support structure as described herein are provided by different types of stitches, different stitch tensions, and use of varying yarns, or a combination thereof. It is therefore necessary to determine the appropriate stitch required in each area, in order that the stitch gives the appropriate control as needed for each area of the bust. It is also necessary to take into account how to link the different stitches so that the machine can properly chain them together into one continuous sleeve. This technique of creating a garment of a continuous sleeve of stitches is used, for example, in the hosiery and seamless underwear industries.

The support system is designed to fit the outer garment such that the inner system and the outer garment match each other. To properly create the inner support system, the power characteristics of each stitch are determined in order to sculpt the desired area. The stitch shapes are determined in the context of the complete support structure. Various stitch tensions and patterns are used to sculpt the area properly and provide different levels of support and control to each main area of the bust—underneath the bust, around the sides of the bust, between the breasts and around the back—so that areas requiring maximum support, medium support and soft support can be addressed. Different stitch patterns have different characteristics determined by the stitch shape and body. The stitch patterns are selected based on the area that needs to be supported and how much support is required in that area, as well as how the areas are linked together in the inner support structure. Stitch selection is thus influenced by the shape of the inner support structure (e.g., a high neck, a v-neck, or other shape), the desired level of control and support in each individual area of the shape, and how the areas fit together. The power and shape of each stitch is then translated into tensions and adjustments to the sewing machine.

The inner support structure 41 fits into the outer garment 40 such that the inner system and the outer garment match each other. Thus, the number of stitches of the inner support system 41 must be calculated in height and length to fit the outer garment. The support structure is then shaped and fitted so that it can be connected at the perimeters of the outer shell of the garment 40, excluding the side seams.

Figure 5A:
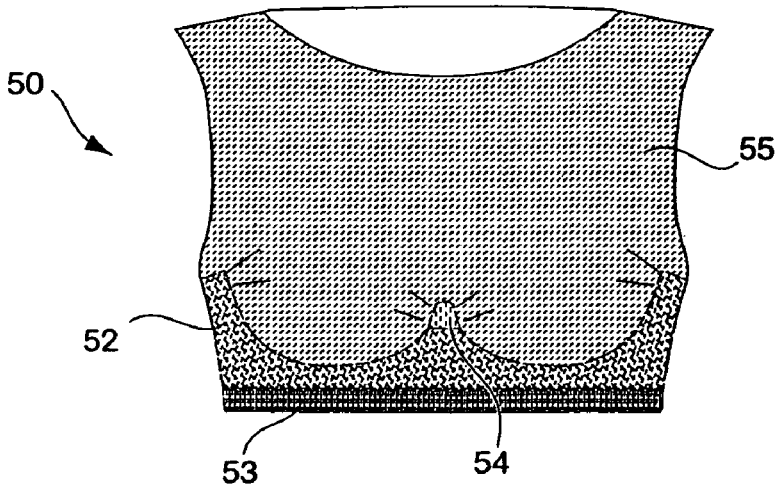
FIGS. 5A and 5B illustrates a stitch pattern of the inner support structure arrangement according to one embodiment of the invention.
Figure 5B:
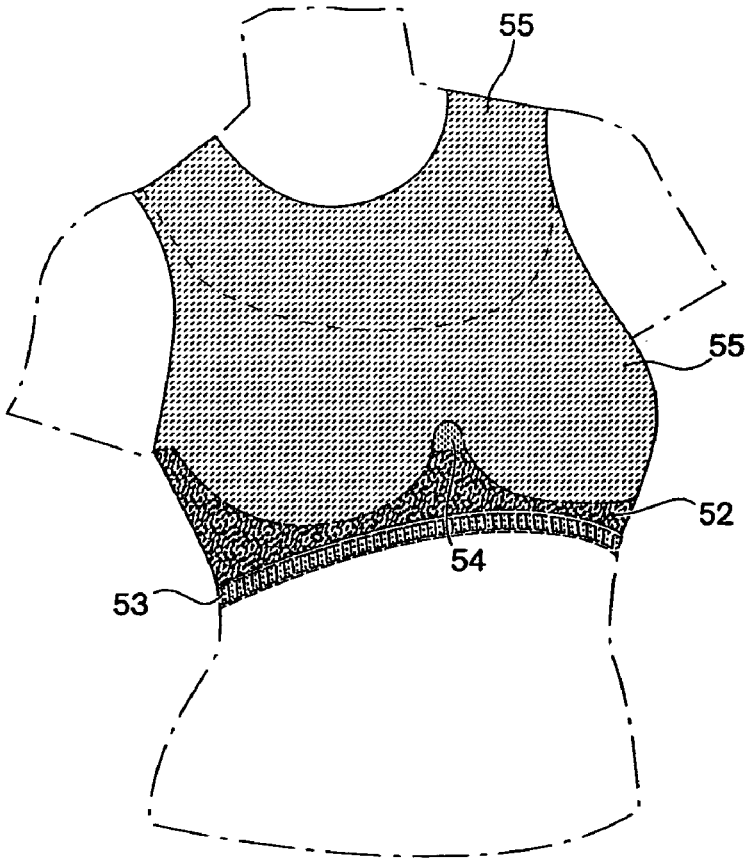

Referring to FIGS. 5A and 5B, an inner support structure 50 showing variance in the stitches is shown. The exemplary stitch areas shown in FIG. 5A and FIG. 5B can be used for the garment depicted in FIG. 4. In FIGS. 5A and 5B, a maximum support having a RIB knit type 52 is shown. The maximum support stitch has the greatest percentage of spandex and can be used under the bust and on the sides of the bust for the most support, or least elasticity. It is shown in FIG. 5B that the maximum support stitch can be, for example, a longer and tighter stitch than that used for other areas of the inner garment, such as area 55, which is a less frequent stitch.

In addition, the supporting inner layer is provided by utilizing a combination of stitch patterns, each with a varying percentage of spandex or other elastic material. Different characteristics of the outer garment, such as fabric, size, and shape, for example, necessitate different levels of support. A maximum support stitch can be folded over to form a RIB-HEM knit type 53 below the bust area. A medium support TAK knit type 54 can be used between the breast, or in the midsection of the inner support structure, where less than maximum support is required and comfort is desired. A soft selection SINGLE knit type 55 can be used over the bust area. The soft selection knit type 55 has the least percentage of spandex.

The supporting inner layer desirably comprises a number of regions having varying levels of control and support. For example, the supporting inner layer may include a maximum support area, a medium support area, and a soft support area. The various support areas will typically have different percentages of stretch, i.e., the maximum support area will have a comparatively smaller percentage stretch, e.g., 170% in the width and 120% in the length; than the medium support area, e.g., having a percentage stretch of 180% wide and 130% lengthwise; than the soft support areas, e.g., 240% in width and 160% lengthwise. The stitch patterns used in the respective support areas will be readily selected by the skilled artisan based on the characteristics of each support area and compatibility of the stitch therewith, e.g., the percentage stretch, the level of support desired, and the particular material(s) chosen.

As mentioned, at least two different yarn types aid in imparting the support and control function to the seamless support structure 41. The at least two yarns may be selected from the group consisting of spandex, cotton, elastane, bare spandex, nylon, nylon single cover and nylon flat shiny. Other yarns are possible and envisioned, such as multifibre, lurex, polyester, polypropylene, covered yarns, and microfibre.

The fabric of the outer garment and the proper treatment used to care for that fabric further influence the stitch pattern and yarn type. For example, a garment that can be ironed or that is dyed can require an adjustment in the level of support used so that the garment and the inner structure continue to fit properly after these processes have been completed one or a number of times. Other considerations may also be a factor in stitch pattern and yarn size.

Thus, the inner support structure is seam-free, making it lightweight and enabling stretching and control of shape, and making it comfortable to wear and ensuring no unsightly seams will be visible through the outer garment to which it will be attached. For example, a seamless machine, such as the Santoni SM8 machine manufactured by Santoni S.p.A. (Italy) can be used to manufacture the inner support structure. The result is a substantial support structure which provides control in varied areas in order to lift and support the breasts.

Figure 6A:
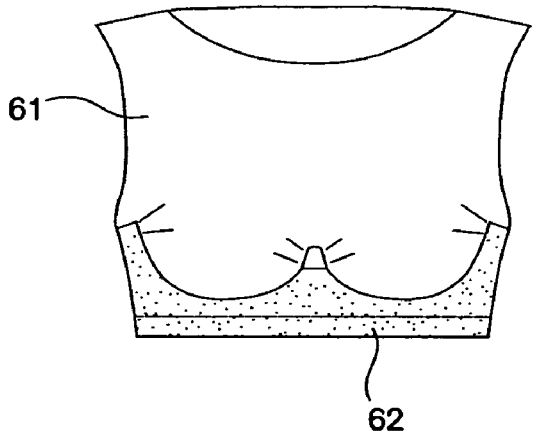
FIGS. 6A and 6B illustrate an alternative embodiment of an outer garment and inner support structure according to the present invention.
Figure 6B:
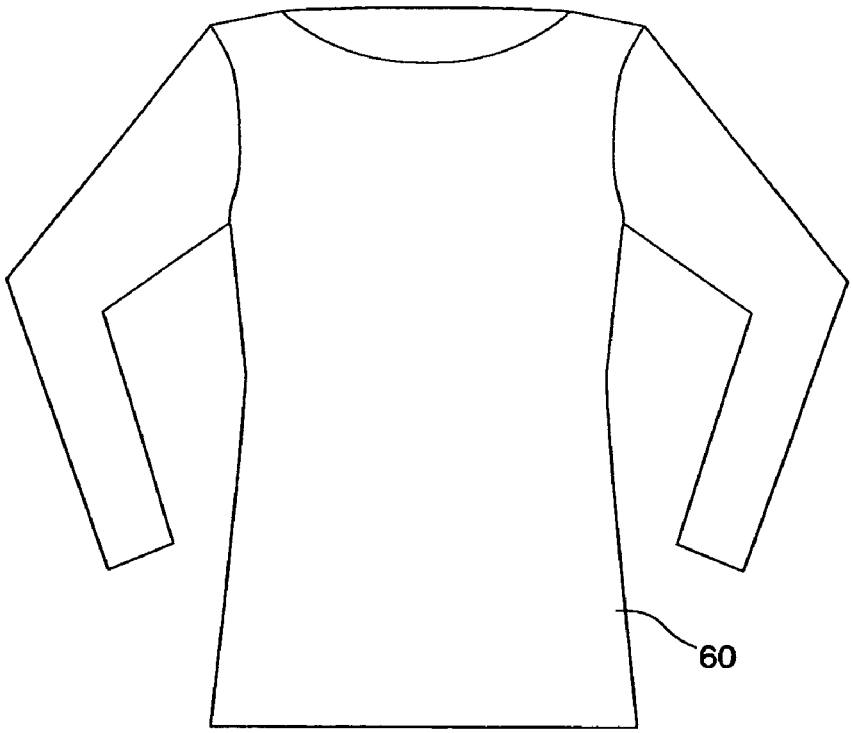
Figure 7A:
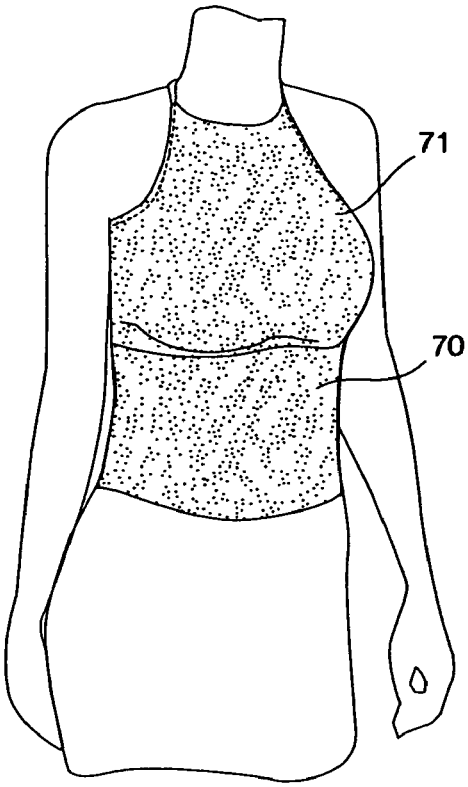
FIGS. 7A, 7B, 7C, 7D, and 7E illustrate an alternative support system according to the present invention.
Figure 7B:
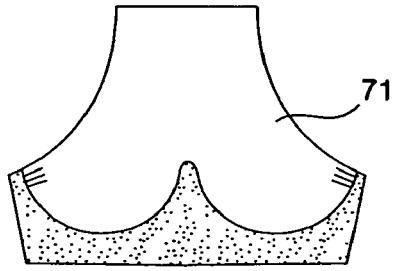
Figure 7C:
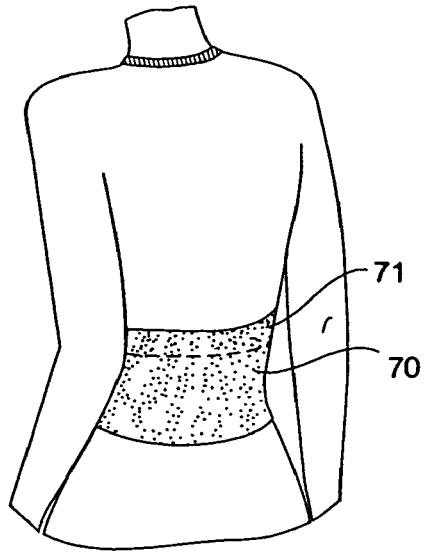
Figure 7D:
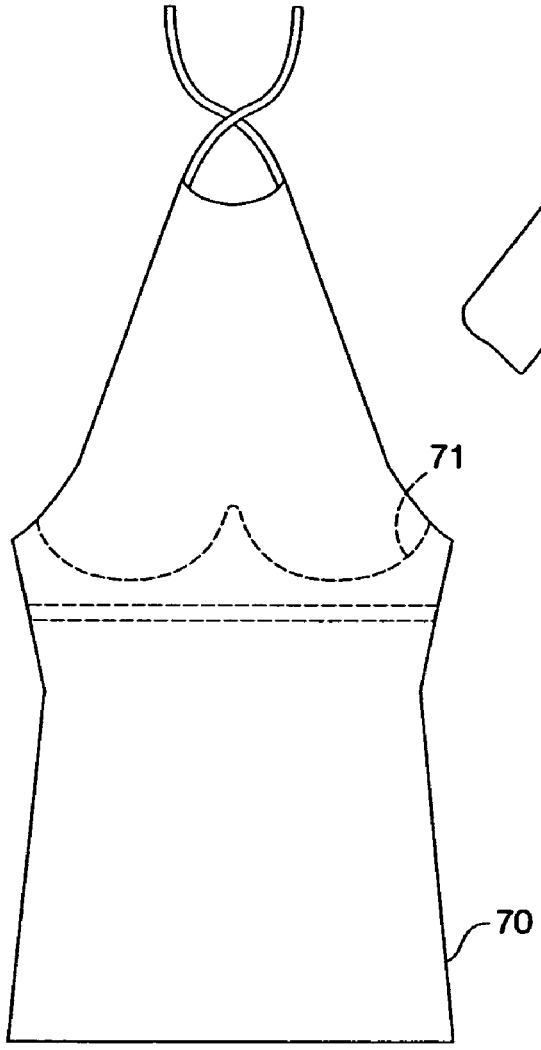
Figure 7E:
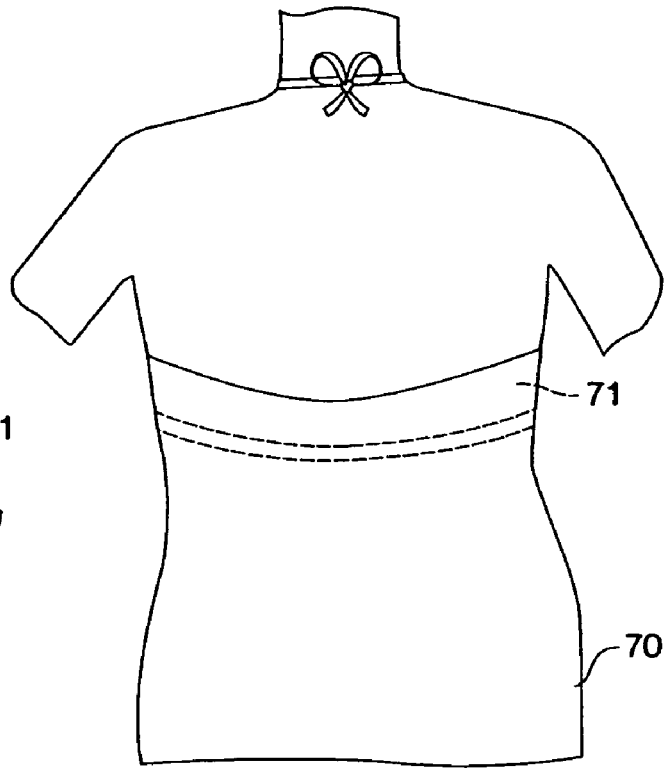
Figure 8A:
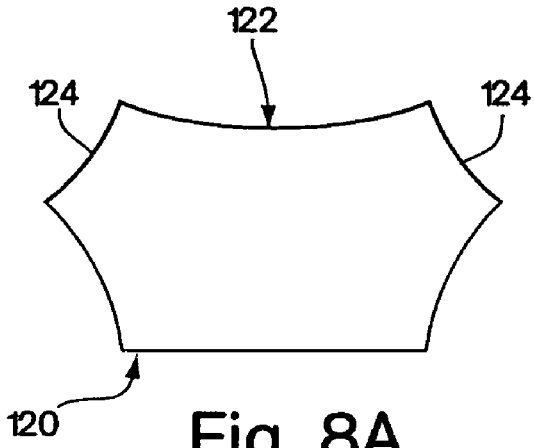
FIGS. 8A, 8B, 8C, and 8D illustrate a front and back view of an outer garment and inner support system arrangement according to the invention, in phantom lines, showing connection points.
Figure 8B:
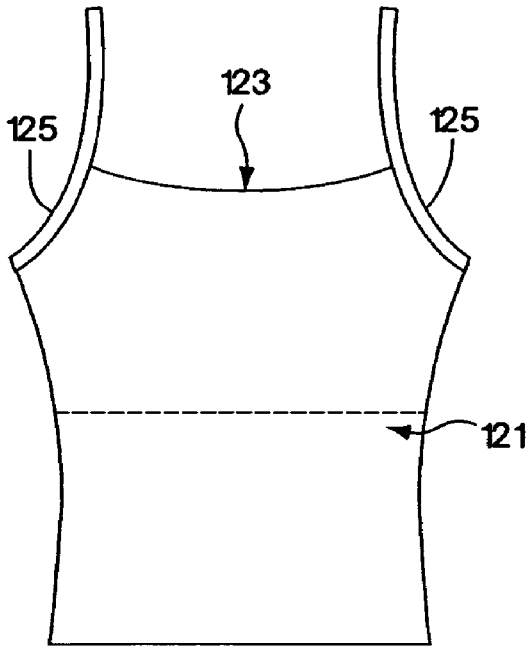
Figure 8C:
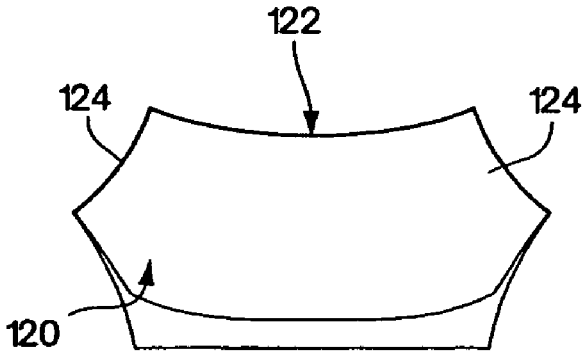
Figure 8D:
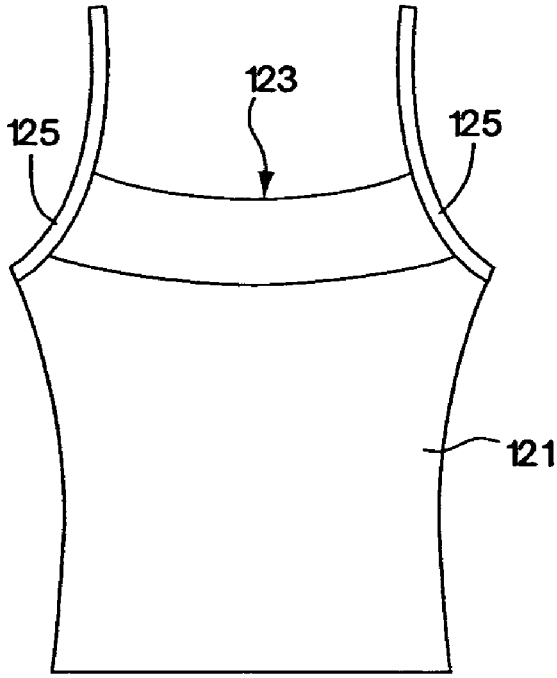
Figure 9A:
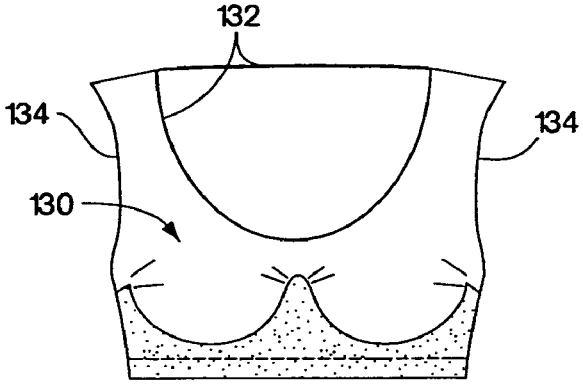
FIGS. 9A, 9B, 9C, and 9D illustrate a front and back view of an alternative outer garment and inner support system arrangement, according to the invention, in phantom lines, showing connection points.
Figure 9B:
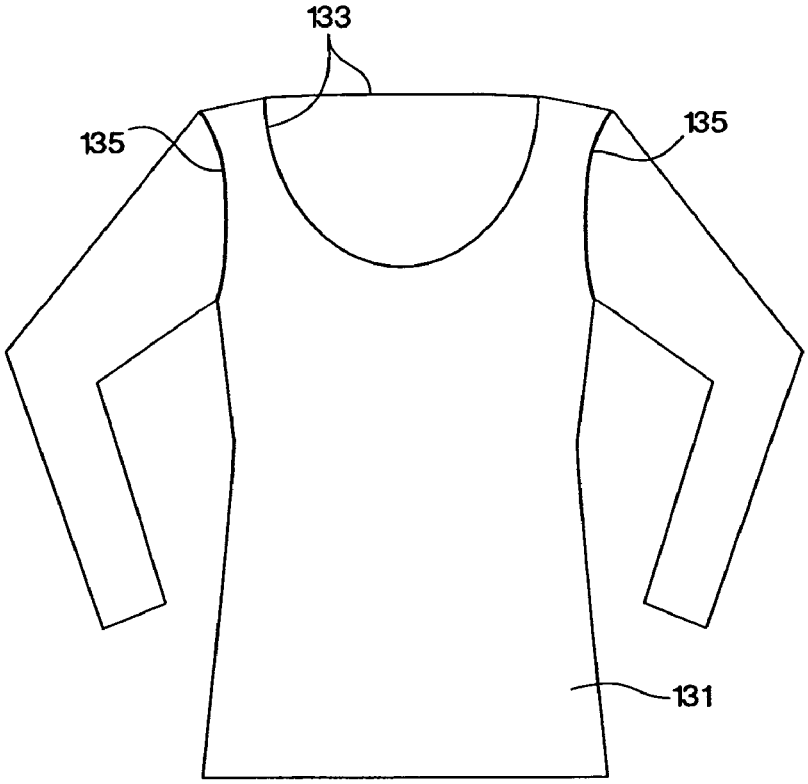
Figure 9C:
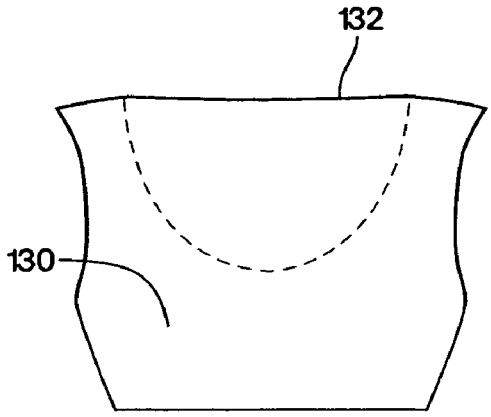
Figure 9D:
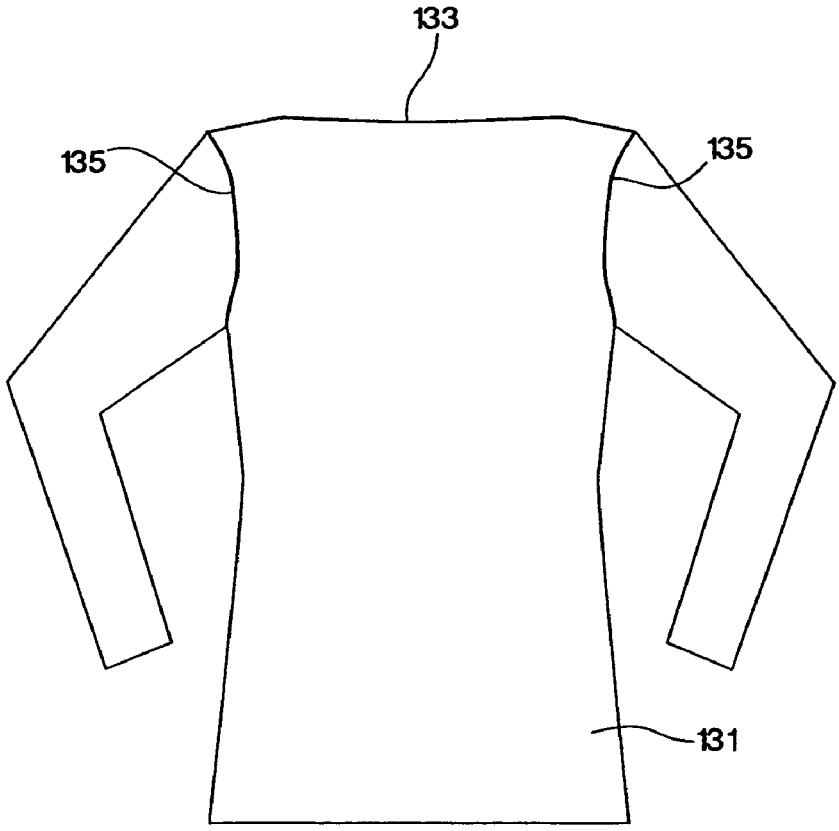

FIG. 6 illustrates an alternative embodiment of an outer garment and inner support structure according to the present invention. The same features of the garment as described in FIG. 5 above apply, i.e., a seam-free inner support structure providing uplift without flattening the breast area. The garment of FIG. 6 also uses varying stitch pattern and yarn, as described with reference to FIG. 5. With a sleeved top 60, there is no need for a separate under garment (such as a bra). The result is that no seams or fabric marks from a separate undergarment are visible through the outer garment. Also, there are no indentation marks under the arms or across the back as is usually common when wearing a bra underneath a fitted garment. The inner support structure 61 and 62 and outer garment 60 are connected at their perimeters, such as around the entire neckline, across both shoulder seams and around the armholes.

FIG. 7 illustrates an alternative inner support system 71 for a halter top outer garment 70 which has straps that go around the wearer's neck. FIGS. 7A, 7C, 7D and 7E illustrate a front and back view of a clothing article of the invention such as haltemeck 70, showing the body of inner layer 71 shaded in. Thus, it is shown by FIG. 7 that the support structure 71 need not comprise shoulder straps, as would be the case if the support structure is used as a liner within a camisole top, vest top, t-shirt, or long sleeve top. Additionally, FIGS. 7D and 7E illustrate, with phantom lines, the location of stitches used to attach the outer garment 70 to the inner garment 71.

Referring to FIG. 8, a front view of the phantom figure reveals the operation of the inner support structure. The inner liner is sewn along the perimeter of the outer garment, i.e., around the entire neckline (front and back), around the armholes and across the top of the shoulders. FIG. 8A is a front view of inner support structure 120. FIG. 8B is a front view of the tank top outer 121. FIG. 8C is a back view of inner support structure 120, and FIG. 8D is a back view of the tank top outer; the corresponding connection points are shown. The liner 120 is stitched into the outer tank top 121 along the following connection points: the neckline seam 122 of inner support structure 120 is stitched into the neckline seam 123 of tank top outer 121, and the underarm seam 124 of inner 120 is stitched into underarm seam 125 of tank top outer 121. The inner structure 120 is not secured to the outer garment 121 at the side seams. When a woman puts on the top, the breasts are supported by the inner structure which lift the breasts upwards and forward in a comfortable snug fit against the single ply outer garment. The inner structure 120 is constructed of a somewhat smaller size than outer garment 121, in order that the inner liner 120 is able to perform its form fitting and support function, while still being able to fit within and be attached to the outer garment.

FIG. 9 illustrates a front and back view of an alternative outer garment and inner support system arrangement, according to the invention showing connection points. The outer garment 131 is a long sleeve shirt in FIG. 9. FIG. 9A shows the inner support structure 130 from a front perspective, which corresponds to the front perspective of the outer garment 131 shown in FIG. 9B. The backside views of the inner structure 130 and outer garment 131 are shown in FIGS. 9C and 9D. In connecting the inner structure to the outer garment, stitching is applied to the neckline 132 of the inner structure to correspond to the neckline of the outer structure 133, and the armholes of the inner structure 134 are likewise matched with the armholes 135 of the outer garment for stitching purposes. It is particularly shown by the illustrated examples in FIGS. 8 and 9 that the shapes of the outer garments vary. In all cases however, the inner support structures are manufactured to specifically fit within the shape of the outer garments, while retaining the control and support function. The inner liners are sewn at the common perimeters (around the neckline, across shoulders where there are shoulders and around the armholes where there are armholes), which provides the desired structure and appearance.

Figure 10A:
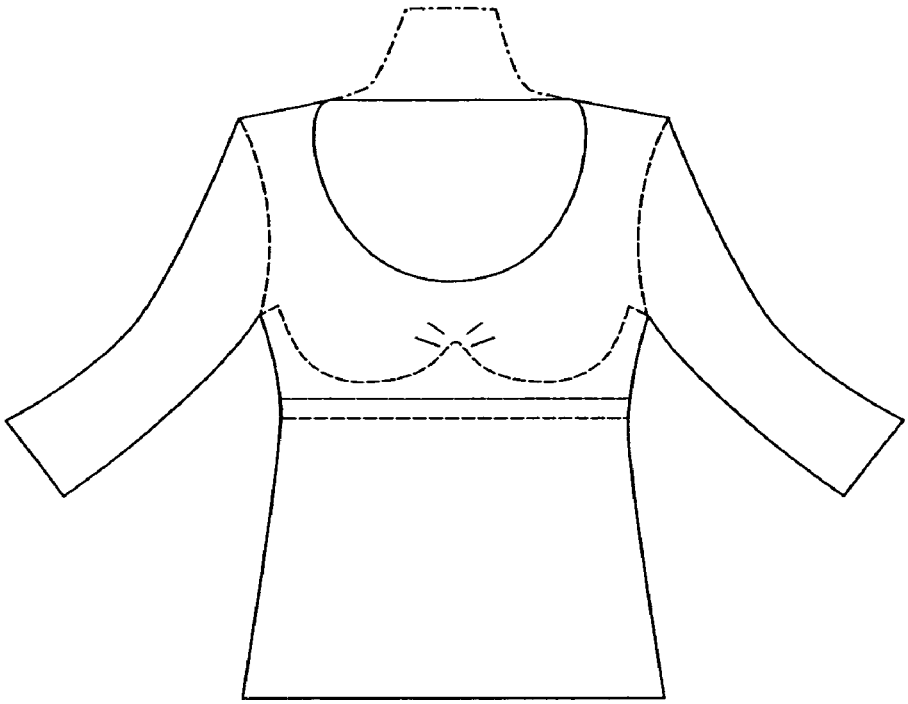
FIG. 10 illustrates an alternative embodiment of garments according to the invention.
Figure 10B:
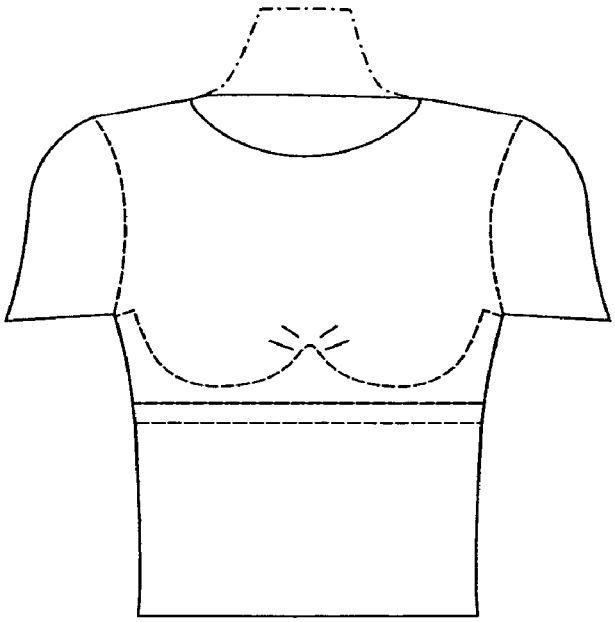

FIGS. 10A and 10B illustrate alternative embodiments of a garment according to the invention, showing the inner structure with phantom lines. The long sleeve top of FIG. 10A is a preferred embodiment including the inner support structure. The phantom lines illustrate stitch areas in both the long sleeve shirt and the short sleeve t-shirt of FIG. 10B.

The articles of clothing according to the invention advantageously provide breast support with increased comfort for regular use or for physical activity with a feeling of security and without the pain which can be associated with unsupported breasts. It is to be understood that the present invention is not restricted to the selected types of stitches mentioned above, since it is contemplated that other equivalent modifications can be used to obtain similar results depending upon the requirements of use and the degree of control of support and sculpturing desired.

The present invention incorporates the techniques employed within hosiery manufacturing in view of the fact that hosiery is inexpensive, light, and seamless, making it nearly invisible from outside of outer garments, as there are no ridges caused by cutting and sewing. In view of these advantages it is desirable to adapt the techniques of producing hosiery to the process of producing garments and support structures of the present invention. One of the features of the present invention is that the support structures do not have seams. Using the hosiery manufacturing approach allows for the production of a glove-like support structure while permitting control of the stitch pattern and tightness of stitch, as well as interchanging a selection of yarns to advantageously sculpt a woman's body. As a result, the glove-like structure of the support structure is seamless and cheap, yet has durable properties, as well as being capable of stretching and controlling shape and being comfortable to wear, as well as providing a streamlined appearance.

As a result of the present invention a seamless, lightweight, and very substantial inner support structure which provides control in varied areas in order to lift and support the breasts providing shape and contour without flattening the area is made available.

As used herein, the term "garment" refers to women's clothing apparel that covers the upper body region including the breasts. Such 'garments' include, but are not limited to, sleeveless tops of all designs (e.g., tank tops, halter tops, bandeau tops, camisoles, crop tops etc), tops of various designs with sleeves of all lengths (e.g., cap sleeve tops, t-shirts, shorter sleeved tops, three quarter sleeve tops, long sleeve tops, etc.), dresses (sleeveless, strapless, with sleeves or otherwise), shirts, and body suits. A preferred application of the inner support structure of the present invention is in long sleeve or other sleeved tops. Variations and modifications may be made to the inner support structure without departing from the scope of the invention as described herein. The inner support structure can be fitted to the design and shape of any outer garment.

From the foregoing detailed description it has been shown how the objects of the invention have been obtained in a preferred manner. However, modifications and equivalence of the disclosed concepts such as those which would occur to one of ordinary skill in the art are intended to be included within the scope of the present invention. Such equivalents are considered to be within the scope of the present invention and are covered by the following claims. Various substitutions, alterations, and modifications may be made to the invention without departing from the spirit and scope of the invention as defined by the claims. Other aspects, advantages, and modifications are within the scope of the invention. The contents of all references, issued patents, and published patent applications cited throughout this application are hereby incorporated by reference. The appropriate components, processes, and methods of those patents, applications and other documents may be selected for the present invention and embodiments thereof.

What is claimed is:

1. An integrated garment comprising:

a) a cut-and-sew outer layer comprising at least one of a long-sleeve shirt, a short-sleeve shirt, a dress, or a sweater for covering a woman's breasts, the outer layer including a top end, a bottom end and side seams; and b) a seamless inner layer having a perimeter and a substantial support structure extending from a front of the garment to a back of the garment in at least a bust region of the garment, wherein the inner layer includes at least two different stitch patterns each having a respective yarn and wherein the inner layer is substantially attached along at least a portion of the perimeter to the outer garment and is configured to substantially support the woman's breasts.

2. The garment according to claim 1, wherein the stitch patterns comprise at least two of the following stitch patterns selected from the group consisting of:

i) a maximum support stitch, under the bust, at the sides of the bust, or between the breasts or mid section, or a combination thereof;

ii) a medium support stitch, in the back portion of the inner layer; and iii) a soft selection area stitch, over the bust area.

3. The garment according to claim 1, wherein the support structure includes at least two different yarns for imparting a support and control function to the support structure.

4. The garment according to claim 3, wherein the yarns are selected from the group consisting of: cotton and microfiber each in combination with an elasticized material.

5. The garment according to claim 3, wherein the yarns are selected from the group consisting of: spandex, bare spandex, nylon, nylon single cover, nylon flat shiny, viscose, polyester, acrylic, wool, cashmere, mohair and rayon.

6. The garment according to claim 1, wherein the inner layer is substantially continuous around the circumference of the top end of the outer layer.

7. The garment according to claim 6, wherein the inner layer is substantially attached at least substantially across the entirety of a perimeter of the top end of the outer layer.

8. The garment according to claim 1, wherein the inner layer is smaller than the outer garment and includes a shape substantially similar to a shape of a top half of the outer layer.

9. The garment according to claim 8, wherein the inner layer is substantially attached to an inside of the outer layer.

10. The garment according to claim 8, wherein the inner layer is substantially attached to a perimeter of the top end of the outer layer.

11. The garment according to claim 10, wherein the inner layer is substantially attached to a perimeter of the top end of the outer layer, substantially around the arm holes and substantially across the shoulders.

12. The garment according to claim 1, wherein the outer layer comprises a top with sleeves having a defined neck line.

13. The garment according to claim 12, wherein the inner layer is substantially attached to the outer layer substantially around an entirety of arm holes defined by the sleeves and to shoulder seams between the neckline and the sleeves.

14. The garment according to claim 1, wherein the outer layer comprises a dress having a top half with or without sleeves.

15. The garment according to claim 14, wherein the inner layer includes a substantially similar shape as at least the top half of the dress, and wherein the inner layer is substantially attached to the outer layer at least at one common perimeter of the top end of the dress, around a neckline, around shoulder seams of the dress, or armholes of the dress.

* * * * *